US008840209B2

(12) United States Patent
Izoe

(10) Patent No.: US 8,840,209 B2
(45) Date of Patent: Sep. 23, 2014

(54) PRINTING DEVICE FOR PRINTING IMAGE ON PRESCRIBED REGION OF PAPER BY USING COMBINATION OF METHODS

(75) Inventor: Shintaro Izoe, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 76 days.

(21) Appl. No.: 13/434,747

(22) Filed: Mar. 29, 2012

(65) Prior Publication Data

US 2013/0002745 A1 Jan. 3, 2013

(30) Foreign Application Priority Data

Jun. 30, 2011 (JP) ..... 2011-145621

(51) Int. Cl.

| | |
|---|---|
| ***B41J 29/38*** | (2006.01) |
| ***B41J 29/393*** | (2006.01) |
| ***B41J 11/00*** | (2006.01) |
| ***B41J 2/21*** | (2006.01) |

(52) U.S. Cl.

CPC ..... *B41J 2/2132* (2013.01); *B41J 29/38* (2013.01); *B41J 11/0065* (2013.01)

USPC ..... 347/14; 347/9; 347/41; 347/16; 347/19; 347/42

(58) Field of Classification Search

CPC ..... B41J 29/38; B41J 29/393

See application file for complete search history.

(56) References Cited

U.S. PATENT DOCUMENTS

| | | | | |
|---|---|---|---|---|
| 5,079,563 | A | 1/1992 | Starkweather et al. | |
| 5,988,790 | A | 11/1999 | Koike et al. | |
| 6,250,734 | B1 | 6/2001 | Otsuki | |
| 6,260,946 | B1 | 7/2001 | Hori | |
| 6,595,619 | B2 | 7/2003 | Barinaga et al. | |
| 6,744,530 | B1 * | 6/2004 | Someno et al. | 358/1.18 |
| 6,883,898 | B2 | 4/2005 | Sato | |
| 7,520,583 | B2 * | 4/2009 | Arazaki et al. | 347/15 |

(Continued)

FOREIGN PATENT DOCUMENTS

| | | | |
|---|---|---|---|
| JP | H09-277601 | A | 10/1997 |
| JP | H11-207945 | A | 8/1999 |

(Continued)

OTHER PUBLICATIONS

Japan Patent Office, Machine translation of JP 2004-216615 A. (Reference cited in IDS filed on Mar. 29, 2012).

*Primary Examiner* — Manish S Shah
*Assistant Examiner* — Jeremy Delozier
(74) *Attorney, Agent, or Firm* — Baker Botts L.L.P.

(57) ABSTRACT

In a printing device, a first control unit prints, by a first print method, an image on a first region of a recording sheet in a first state in which a recording sheet is clamped by both an upstream and downstream clamping portions. A second control unit prints, by a second print method, an image on a second region of the recording sheet in a second state in which the recording sheet is clamped either one of the upstream and downstream clamping portions. A third control unit prints, by a combination of the first and second print methods, an image on a third region of the recording sheet between the first and second regions. When the third control unit prints the image on the third region, a state of the recording sheet is set to be changed from the first state to the second state.

5 Claims, 10 Drawing Sheets

(56) References Cited

U.S. PATENT DOCUMENTS

| | | | | |
|---|---|---|---|---|
| 7,988,251 | B2 * | 8/2011 | Dimitrijevic et al. | 347/12 |
| 2002/0063873 | A1 | 5/2002 | Kakutani et al. | |
| 2004/0080551 | A1 | 4/2004 | Nunokawa | |
| 2008/0284808 | A1 * | 11/2008 | Kano et al. | 347/12 |
| 2008/0298827 | A1 * | 12/2008 | Akiyama et al. | 399/44 |
| 2010/0165032 | A1 * | 7/2010 | Yoshida | 347/15 |
| 2013/0002760 | A1 | 1/2013 | Izoe | |
| 2013/0003082 | A1 | 1/2013 | Izoe | |

FOREIGN PATENT DOCUMENTS

| | | | |
|---|---|---|---|
| JP | H11-286102 | A | 10/1999 |
| JP | 2003-226002 | A | 8/2003 |
| JP | 2004-216615 | A | 8/2004 |
| JP | 2005-349638 | A | 12/2005 |

* cited by examiner

FIG. 3(a) 4n+1
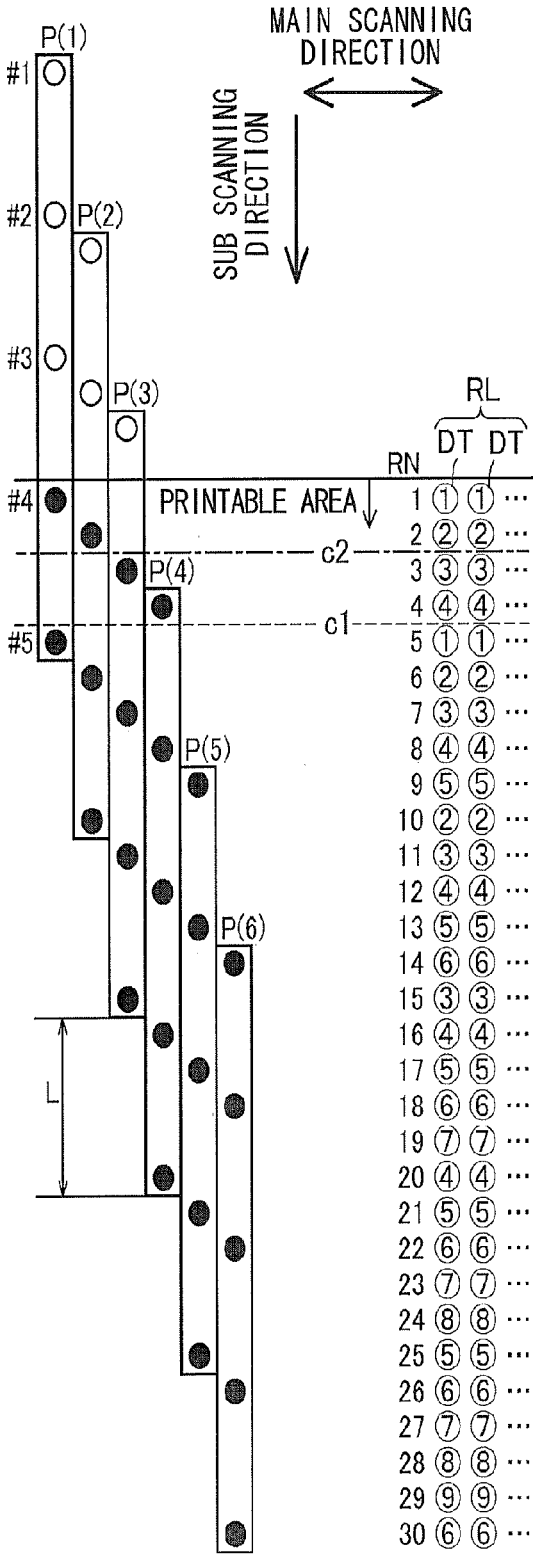
FIG. 3(b) 4n−1
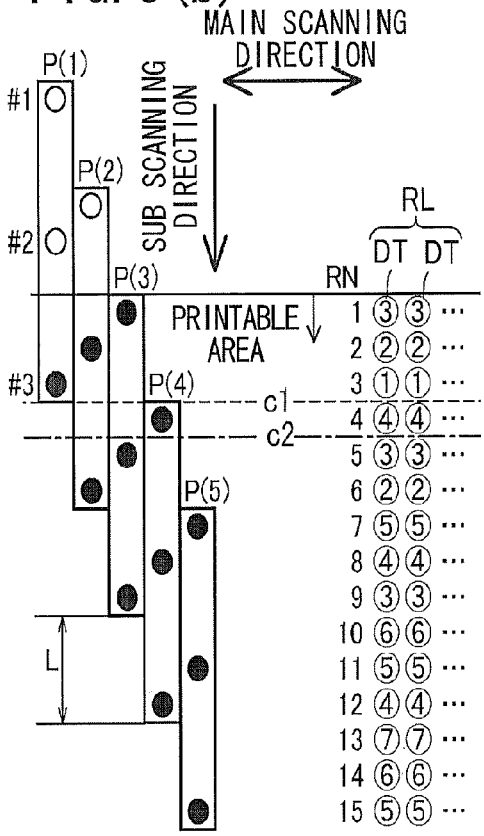

PRINTING DEVICE FOR PRINTING IMAGE ON PRESCRIBED REGION OF PAPER BY USING COMBINATION OF METHODS

CROSS REFERENCE TO RELATED APPLICATION

This application claims priority from Japanese Patent Application No. 2011-145621 filed Jun. 30, 2011. The entire content of the priority application is incorporated herein by reference.

TECHNICAL FIELD

The invention relates to a printing device capable of reducing defects in images formed through interlaced printing.

BACKGROUND

Printing devices that print images by ejecting dots on a print medium are in widespread use. Some such printing devices employ an interlaced printing method known in the art in which dots are formed on adjacent main scanning lines in different main scans. Using interlaced printing, a printing device can print at a higher resolution, whereby the pitch of dots in the sub-scanning direction (the line spacing of adjacent main scanning lines) is smaller than the nozzle pitch in the sub-scanning direction.

There exists in the art a technology for expanding a printing region in which interlaced printing can be performed while ensuring the precision for conveying a print medium (sub scan precision). Specifically, the technology switches the printing method from a method that uses a large conveying distance to convey the print medium to a method that uses a small conveying distance at a timing approaching the point that the print medium transitions from a state held both by paper-supply rollers (upstream-side rollers) and by paper-discharge rollers (downstream-side rollers) of the conveying mechanism (hereinafter referred to as a double-clamped state) to a state in which the end of the print medium separates from one of the roller pairs (the paper-supply rollers; hereinafter referred to as a single-clamped state). This enables the device to expand the printing region within which printing can be performed in a double-clamped state. Note that dots have already been formed in main scan lines through previous main scans for which dots can be formed in main scans after the printing method was switched.

SUMMARY

However, the conventional technology described above does not necessarily do enough to ensure printing quality during and after the transition from the double-clamped state to the single-clamped state. Therefore, the conventional printing device is potentially unable to suppress a decline in the quality of the image portion printed during and after the transition of the print medium from the double-clamped state to the single-clamped state. This type of issue is common when the clamped state of the print medium changes.

The primary advantage of the invention is the ability to provide an interlaced printing technology capable of suppressing a decline in the quality of the portion of an image printed while the clamped state of the print medium changes.

In order to attain the above and other objects, the invention provides a printing device. The printing device includes a print head, a conveying portion, a main scanning portion, and a head drive portion. The print head includes a plurality of nozzles arranged in a first direction and spaced apart by a prescribed nozzle pitch. The plurality of nozzles is configured to form dots having a same color on a recording sheet. The conveying portion is configured to convey a recording sheet in the first direction. The conveying portion includes an upstream clamping portion disposed upstream of the print head in the first direction and a downstream clamping portion disposed downstream of the print head in the first direction. The upstream clamping portion and the downstream clamping portion are configured to clamp and convey the recording sheet thereat. The main scanning portion is configured to perform a scan in which the main scanning portion moves the print head relative to the recording sheet in a second direction different from the first direction. The head drive portion is configured to drive at least one nozzle of the plurality of nozzles to form dots such that a raster line configured of the dots extends in a second direction different from the first direction. The print control processor is configured to perform a print operation in a resolution in which a plurality of raster lines is arranged in the first direction by a line pitch smaller than the nozzle pitch by using a first print method and a second print method and by controlling the print head, the conveying portion, the main scanning portion, and the head drive portion. Each of the first print method and the second print method prints the plurality of raster lines in a prescribed order. The prescribed order is specific to each of the first print method and the second print method. The print control processor is configured to function as a first control unit, a second control unit, and a third control unit. The first control unit is configured to print, by the first print method, an image on a first region of the recording sheet in a first state in which the recording sheet is clamped by both the upstream clamping portion and the downstream clamping portion. The second control unit is configured to print, by the second print method, an image on a second region of the recording sheet in a second state in which the recording sheet is clamped either one of the upstream clamping portion and the downstream clamping portion. The third control unit is configured to print, by a combination of the first print method and the second print method, an image on a third region of the recording sheet. The third region is between the first region and the second region. When the third control unit prints the image on the third region, a state of the recording sheet is set to be changed from the first state to the second state. In the first method, the main scanning portion performs a first scan as the scan, whereas in the second method, the main scanning portion performs a second scan as the scan. The third control unit is configured to form dots to form at least one special raster line in the second direction in the third region during both the first scan in the first print method and the second scan in the second print method.

According to another aspect, the invention provides a non-transitory computer readable storage medium storing a set of program instructions installed on and executed by a computer for controlling a printing device. The printing device includes a print head, a conveying portion, a main scanning portion, and a head drive portion. The print head includes a plurality of nozzles arranged in a first direction and spaced apart by a prescribed nozzle pitch. The plurality of nozzles is configured to form dots having a same color on a recording sheet. The conveying portion is configured to convey a recording sheet in the first direction. The conveying portion includes an upstream clamping portion disposed upstream of the print head in the first direction and a downstream clamping portion disposed downstream of the print head in the first direction. The upstream clamping portion and the downstream clamping portion are configured to clamp and convey the recording sheet thereat. The main scanning portion is configured to perform a scan in which the main scanning portion moves the print head relative to the recording sheet in a second direction different from the first direction. The head drive portion is configured to drive at least one nozzle of the plurality of nozzles to form dots such that a raster line configured of the dots extends in a second direction different from the first direction. The program instructions includes (a) performing a print operation in a resolution in which a plurality of raster lines is arranged in the first direction by a line pitch smaller than the nozzle pitch by using a first print method and a second print method and by controlling the print head, the conveying portion, the main scanning portion, and the head drive portion, where each of the first print method and the second print method prints the plurality of raster lines in a prescribed order, where the prescribed order is specific to each of the first print method and the second print method. The performing instruction (a) includes: (a-1) printing, by the first print method, an image on a first region of the recording sheet in a first state in which the recording sheet is clamped by both the upstream clamping portion and the downstream clamping portion; (a-2) printing, by the second print method, an image on a second region of the recording sheet in a second state in which the recording sheet is clamped either one of the upstream clamping portion and the downstream clamping portion; and (a-3) printing, by a combination of the first print method and the second print method, an image on a third region of the recording sheet, where the third region is between the first region and the second region. When the printing instruction (a-3) prints the image on the third region, a state of the recording sheet is set to be changed from the first state to the second state. In the first method, the main scanning portion performs a first scan as the scan, whereas in the second method, the main scanning portion performs a second scan as the scan. The printing instruction (a-3) forms dots to form at least one special raster line in the second direction in the third region during both the first scan in the first print method and the second scan in the second print method.

BRIEF DESCRIPTION OF THE DRAWINGS

In drawings:

FIG. 2(*b*) is a schematic diagram illustrating a structure of a print head when viewed from a bottom in FIG. 2(*a*);

FIG. 3(*a*) is an explanation diagram illustrating a 4n+1 printing method;

FIG. 3(*b*) is an explanation diagram illustrating a 4n−1 printing method;

FIG. 4(*b*) is an explanation diagram illustrating a 8n−3 printing method;

FIG. 6(*b*) is an explanation diagram showing a downstream single-clamped state where a paper is gripped and conveyed only by the downstream clamping unit;

FIG. 6(*c*) is a graph showing variations in an actual unit conveying distance of a conveyance mechanism during a printing operation;

DETAILED DESCRIPTION

A. First Embodiment

A-1. Structure of a Printing Device

Figure 1:
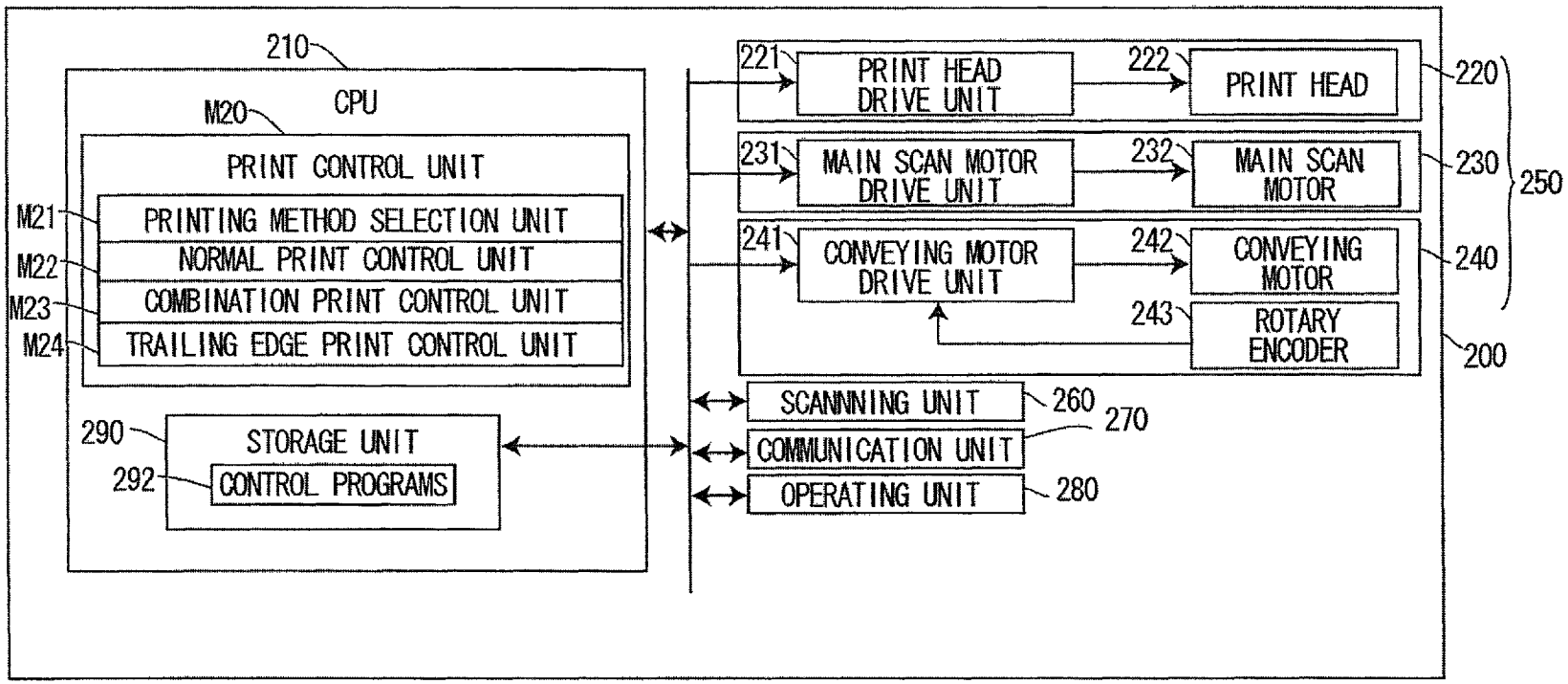
FIG. 1 is a block diagram showing a structures of a multifunction peripheral (MFP) according to a first embodiment.

Next, embodiments of the invention will be described. FIG. 1 is a block diagram showing the structures of a multifunction peripheral (MFP) 200 according to a first embodiment, and a configuration system 1000 for configuring settings on the MFP 200.

The MFP 200 includes a CPU 210, an inkjet printing unit 250; a flatbed scanning unit 260; a communication unit 270 provided with an interface for connecting to a personal computer or other type of computer, or an external storage device such as USB memory; an operating unit 280 having a control panel and various buttons; and a storage unit 290 including RAM, ROM, and a hard disk. The communication unit 270 can carry out data communications with the computer or the external storage device connected to the interface of the communication unit 270.

The storage unit 290 stores control programs 292. By executing the control programs 291, the CPU 210 functions as the control unit of the MFP 200. FIG. 1 selectively shows functional units relevant to the following description from among the functional units that make up the control unit of the MFP 200. Specifically, the CPU 210 functions as a print control unit M20 for controlling the inkjet printing unit 250 to execute printing operations. The print control unit M20 includes a printing method selection unit M21, a normal print control unit M22, a combination print control unit M23, and a trailing-edge print control unit M24.

The inkjet printing unit 250 performs printing operations by ejecting ink in the colors cyan (C), magenta (M), yellow (Y), and black (K). The inkjet printing unit 250 includes an ink ejection mechanism 220, a main scan mechanism 230, and a conveyance mechanism 240. The conveyance mechanism 240 includes a conveying motor 242, a conveying motor drive unit 241 for driving the conveying motor 242, and a rotary encoder 243. The conveyance mechanism 240 functions to convey a recording medium using the drive force of the conveying motor 242. The ink ejection mechanism 220 includes a print head 222 having a plurality of nozzles (described later), and a print head drive unit 221 for driving at least a portion of the nozzles. The ink ejection mechanism 220 forms images on a recording medium by ejecting ink droplets from the nozzles while the conveyance mechanism 240 conveys the recording medium. The main scan mechanism 230 includes a main scan motor 232, and a main scan motor drive unit 231 for driving the main scan motor 232. The main scan mechanism 230 reciprocates the print head 222 in a main scanning direction (movement in one direction being a main scan) using the drive force of the main scan motor 232.

Figure 2B:
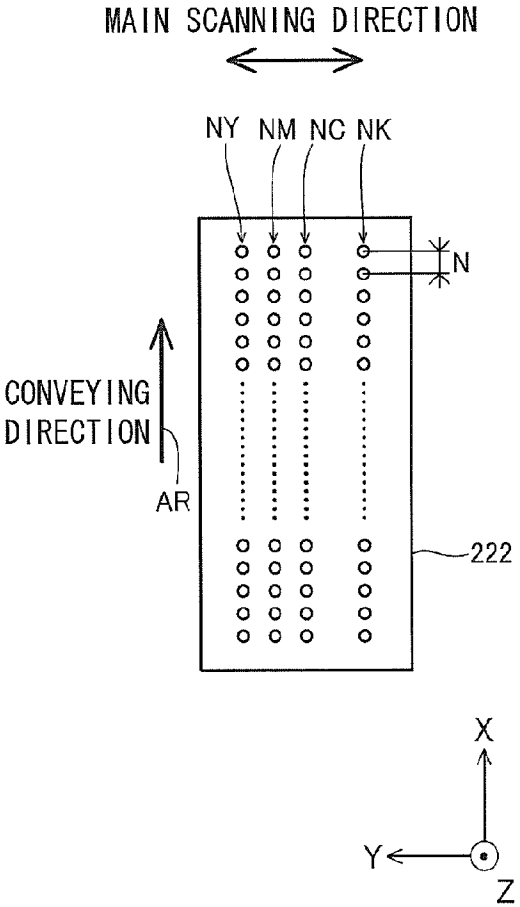
FIG. 2(*a*) is a schematic diagram illustrating a structure of an overall inkjet printing unit.
Figure 2A:
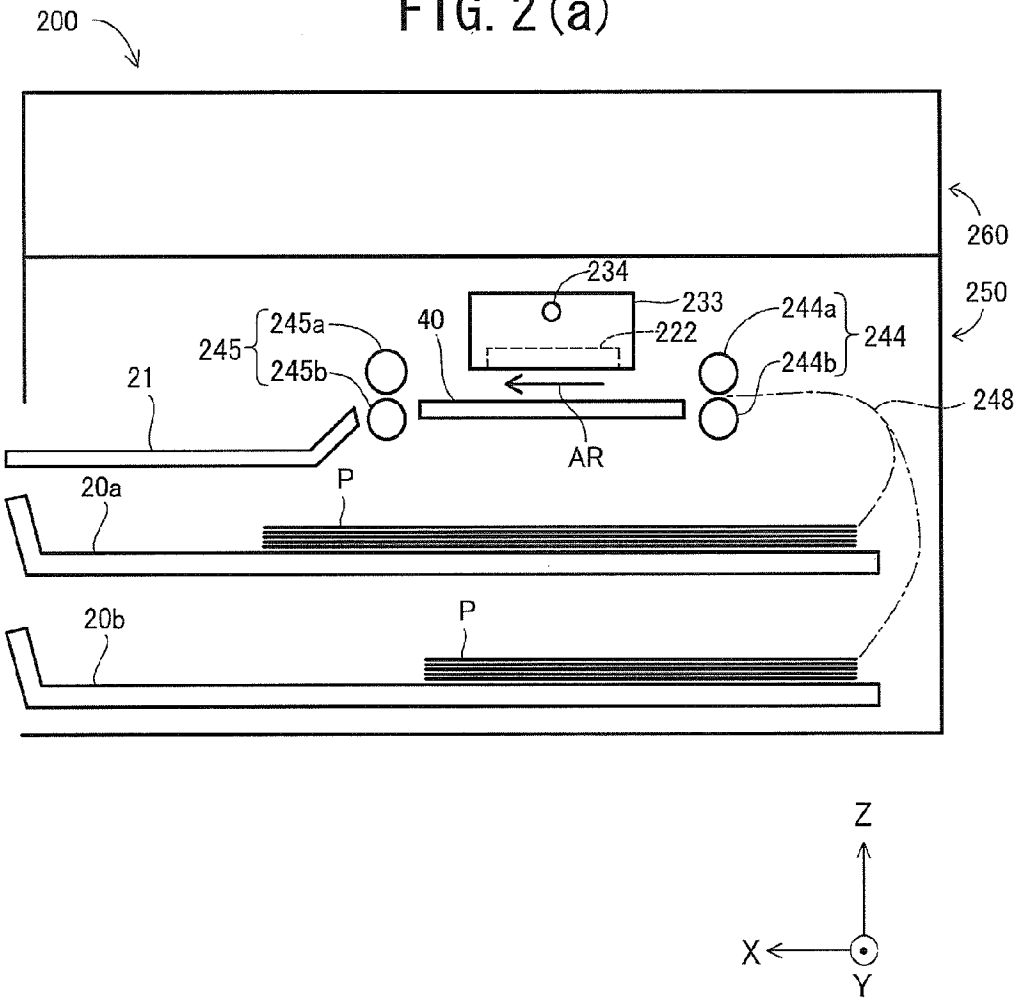

FIG. 2(*a*) illustrates the structure of the overall inkjet printing unit 250, while FIG. 2(*b*) shows the structure of the print head 222 when viewed from the bottom in FIG. 2(*a*). As shown in FIG. 2(*a*), the inkjet printing unit 250 further includes paper trays 20*a* and 20*b* for accommodating paper P serving as the recording medium, a discharge tray 21 for receiving the sheets of paper P discharged from the MFP 200 after being printed, and a platen 40 disposed to confront the surface of the print head 222 from which ink is ejected.

The conveyance mechanism 240 conveys sheets of paper P along a conveying path extending from the paper trays 20*a* and 20*b*, over the platen 40, and to the discharge tray 21. An arrow AR in FIG. 2 indicates the direction in which the paper P is conveyed over the platen 40. Hereinafter, the direction in which the paper P is conveyed over the platen 40 will be referred to as a "conveying direction AR." By conveying the paper P over the platen 40 in the conveying direction AR, the print head 222 moves opposite the conveying direction AR relative to the paper P. The direction opposite the conveying direction AR is referred to as the "sub-scanning direction," and a "sub scan" is the act of moving the print head 222 relative to the paper P or other recording medium in the sub-scanning direction. Further, the side of an object in the direction opposite a prescribed direction will be referred to as the "upstream side" of the prescribed direction, while the side in the prescribed direction will be referred to as the "downstream side" of the prescribed direction.

The conveyance mechanism 240 further includes an upstream clamping unit 244 disposed on the upstream side of the platen 40 relative to the conveying direction AR, a downstream clamping unit 245 disposed on the downstream side of the platen 40 in the conveying direction AR, an upstream conveying path 248 extending from the paper trays 20*a* and 20*b* to the upstream clamping unit 244 (indicated by dotted lines in FIG. 2(*a*)), and an upstream conveying unit (not shown) disposed on the upstream conveying path 248 for conveying the paper P. The upstream clamping unit 244 includes an upstream conveying roller 244*a* that is driven to rotate by the conveying motor 242, and an upstream follow roller 244*b*. Together the rollers 244*a* and 244*b* grip the sheets of paper P and convey the sheets in the conveying direction AR. The downstream clamping unit 245 includes a downstream conveying roller 245*a* that is driven to rotate by the conveying motor 242, and a downstream follow roller 245*b*. Together the rollers 245*a* and 245*b* grip the sheets of paper P and convey the sheets in the conveying direction AR. Alternatively, plate members may be employed in place of the follow rollers 244*b* and 245*b*.

The rotary encoder 243 described above (see FIG. 1) is a rotary sensor that outputs pulses in response to rotation of the upstream conveying roller 244*a*. The conveying motor drive unit 241 described above (see FIG. 1) drives the conveying motor 242 to rotate based on the pulses outputted from the rotary encoder 243 to control the distance in which each sheet of paper P is conveyed. Accordingly, the precision of conveying the paper P is dependent on the resolution of the rotary encoder 243.

The main scan mechanism 230 further includes a carriage 233 in which the print head 222 is mounted, and a sliding shaft 234 for retaining the carriage 233 in a manner that allows the carriage 233 to move reciprocally in the main scanning direction (along the Y-axis in FIG. 2). The carriage 233 performs main scans using the drive force of the main scan motor 232 to reciprocate the carriage 233 along the sliding shaft 234.

As shown in FIG. 2(*b*), nozzle rows NC, NM, NY, and NK for ejecting ink in the respective colors cyan, magenta, yellow, and black are formed in the surface of the print head 222 that opposes the platen 40. Each row of nozzles includes a plurality (210 in this example) of nozzles through which ink of the same color is ejected in order to form dots on the paper P. A piezoelectric element (not shown) is provided for each nozzle for driving the respective nozzle to eject ink. As shown in FIG. 2(*b*), the nozzles in each row are aligned in the sub-scanning direction at a nozzle pitch N. Note that it is also possible to arrange the nozzles of each row in a staggered formation, for example, rather than the linear formation shown in FIG. 2(*b*).

A-2. Printing Methods

Next, the methods of printing supported by the print control unit M20 (see FIG. 1) will be described. The print control unit M20 prints by controlling the ink ejection mechanism 220, the main scan mechanism 230, and the conveyance mechanism 240 to execute a unit print and a unit sub scan repeatedly and alternatingly. The "unit print" is a printing operation performed by driving the nozzles of the print head 222 during a main scan while the sheet of paper P is halted on the platen 40. A single main scan corresponding to a single unit print is also called a "pass." The "unit sub scan" is performed by conveying the sheet of paper P in the conveying direction AR exactly a prescribed unit conveying distance L.

Figure 4A:
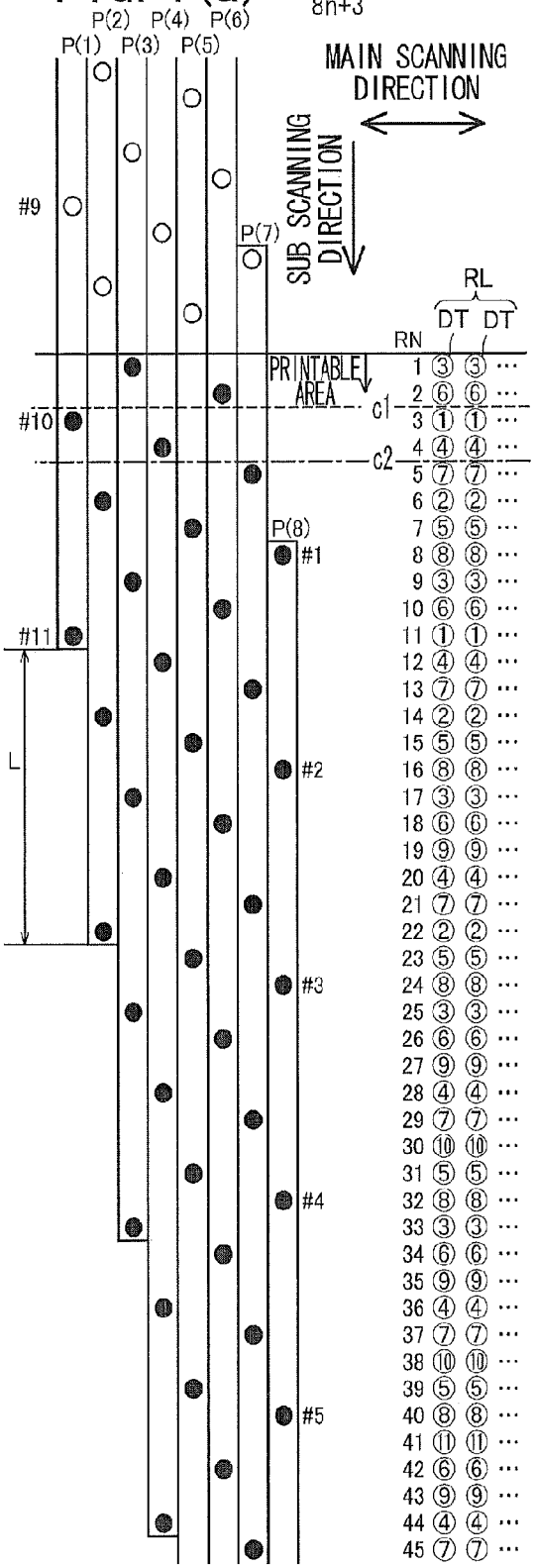
FIG. 4(*a*) is an explanation diagram illustrating a 8n+3 printing method.
Figure 4B:
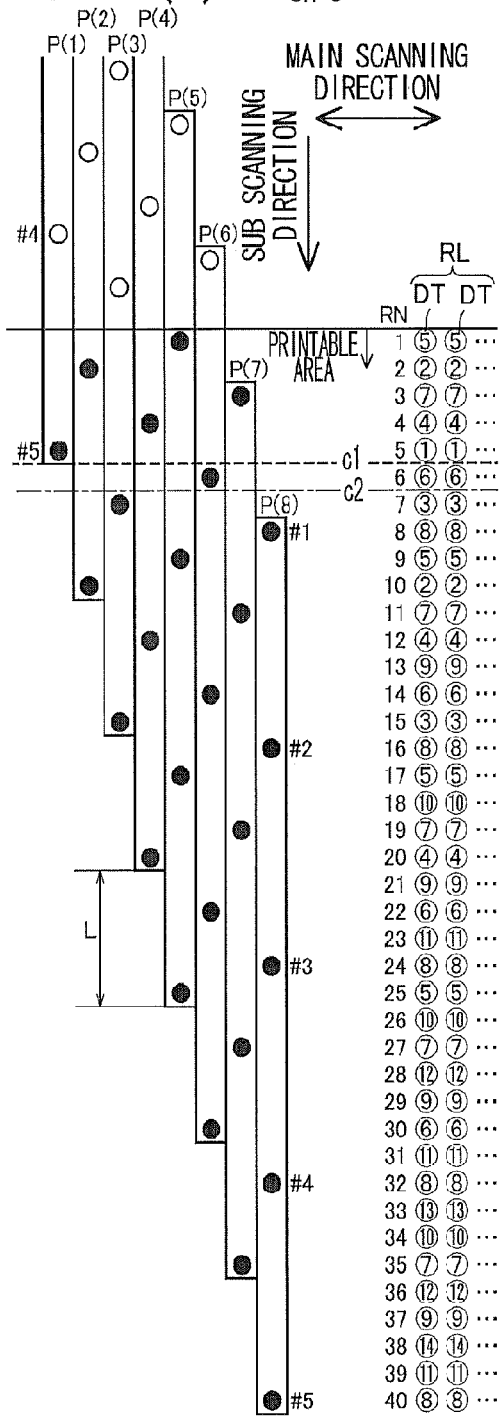

The print control unit M20 can perform interlaced printing using two types of printing methods with respect to "four passes" and two types of printing methods with respect to "eight passes". FIGS. 3(*a*) and 3(*b*) illustrate four-pass printing methods. FIG. 3(*a*) illustrates a 4n+1 printing method, while FIG. 3(*b*) illustrates a 4n−1 printing method. FIGS. 4(*a*) and 4(*b*) illustrate eight-pass printing methods. FIGS. 4(*a*) and 4(*b*) illustrate 8n+3 and 8n−3 printing methods, respectively.

With interlaced printing, the MFP 200 can print at a higher resolution in which the line spacing (dot pitch in the sub-scanning direction) of a plurality of raster lines RL is smaller than the nozzle pitch N of nozzles arranged in the sub-scanning direction. Here, a raster line RL is a line formed by dots DT aligned in the main scanning direction. A printed image is formed by arranging a plurality of raster lines RL in the sub-scanning direction. Each of the raster lines forming the printed image is assigned a sequential raster number RN in order from the upstream side to the downstream side in the sub-scanning direction. In the following description, a raster line RL having raster number j (where j is a natural number) will be given the notation raster line RL(j).

FIGS. 3(*a*) through 4(*b*) show the positions of the nozzles relative to the sub-scanning direction for each pass. The number of passes k of a printing method is expressed as <nozzle pitch N>/<line spacing D>. Hence, a four-pass printing method denotes printing at a line spacing D of one-fourth the nozzle pitch N of the nozzles being used, and an eight-pass printing method denotes printing at a line spacing D of one-eighth the nozzle pitch N. In other words, when using an eight-pass printing method, the MFP 200 can print at twice the resolution in the sub-scanning direction than when using a four-pass printing method. Further, the notation "P(m)" is used to identify each pass, where "m" indicates the order in which each pass is executed. The numbers included under dots DT in the drawings for each raster line denote the pass in which a dot DT is formed on the corresponding raster line RL. For example, dots DT on raster lines RL(1) and RL(5) are formed in pass P(1), while dots DT on raster lines RL(2), RL(6), and RL(10) are formed in pass P(2).

The solid horizontal lines included in each drawing represent the start of the printable area. Thus, raster lines RL cannot be printed on the upstream side of (above, in the drawings) this horizontal line with respect to the sub-scanning direction.

The name given to each printing method is expressed in the form "kn+b," where n is a natural number determined by the number of nozzles being used, k is the number of passes represented by N/D and is a value of 3 or greater, and b is a non-zero integer satisfying the expression $-(1/2)k<b<(1/2)k$. The "kn+b" defines a printing method in which the number of nozzles used is (kn+b) and the unit conveying distance L is D×(k×n+b). For example, the 4n+1 printing method shown in FIG. 3(*a*) is a four-pass printing method that uses 201 nozzles to print a unit conveying distance L that is 201 times the line spacing D (when n=50). Similarly, the 8n+3 printing method shown in FIG. 4(*a*) is an eight-pass printing method (hence, the line spacing D is half the line spacing D in a four-pass printing method) that uses 203 nozzles to print a unit conveying distance L that is 203 times the line spacing D (when n=25), for example. In order to avoid needless complexity in the drawings, all examples illustrate a case in which n=1. The unit conveying distance L in these examples is an ideal conveying distance equivalent to the line spacing for all printed raster lines and will be called the "target unit conveying distance L." The actual unit conveying distance is the sum of the target unit conveying distance L and an error ΔL (L+ΔL). The line spacing D used in these examples is an ideal line spacing D achieved with the ideal unit conveying distance L and will be called the "target line spacing D." The actual line spacing is the sum of the target line spacing D and an error ΔD (D+ΔD).

The printing methods 4n+1 (see FIG. 3(*a*)) and 4n−1 (see FIG. 3(*b*)) are similar in that they are both four-pass printing methods, but differ in the order in which the raster lines composing the printed image are printed. In other words, the order in which the raster lines are printed is determined by the printing method. Here, a description will be given of a pass P(m) for printing regions of the image, excluding the ends of the image in the sub-scanning direction. In interlaced printing, each pass P(m) prints raster lines both (1) in a partially printed region that has already been printed by some of the raster lines in the previous pass P(m−1) and (2) in a region downstream of the partially printed region in the sub-scanning direction. In the 4n+1 method, each pass P(m) prints raster lines in the partially printed region that are adjacent to the raster lines printed in the previous pass P(m−1) and on the downstream side of the same with respect to the sub-scanning direction. In the 4n−1 method, each pass P(m) prints raster lines in the partially printed region that are adjacent to the raster lines printed in the previous pass P(m−1) and on the upstream side of the same with respect to the sub-scanning direction.

The printing methods 8n+3 (see FIG. 4(*a*)), and 8n−3 (see FIG. 4(*b*)) are similar in that they are all eight-pass printing methods, but differ in the order for printing the plurality of raster lines composing each printed image. More specifically, the pass P(m) in the 8n+3 method prints raster lines in the partially printed region positioned three lines downstream in the sub-scanning direction of the raster lines printed in the previous pass P(m−1). The pass P(m) in the 8n−3 method print raster lines in the partially printed region positioned three lines upstream in the sub-scanning direction of the raster lines printed in the previous pass P(m−1).

A-3. Printing Process

Figure 5:
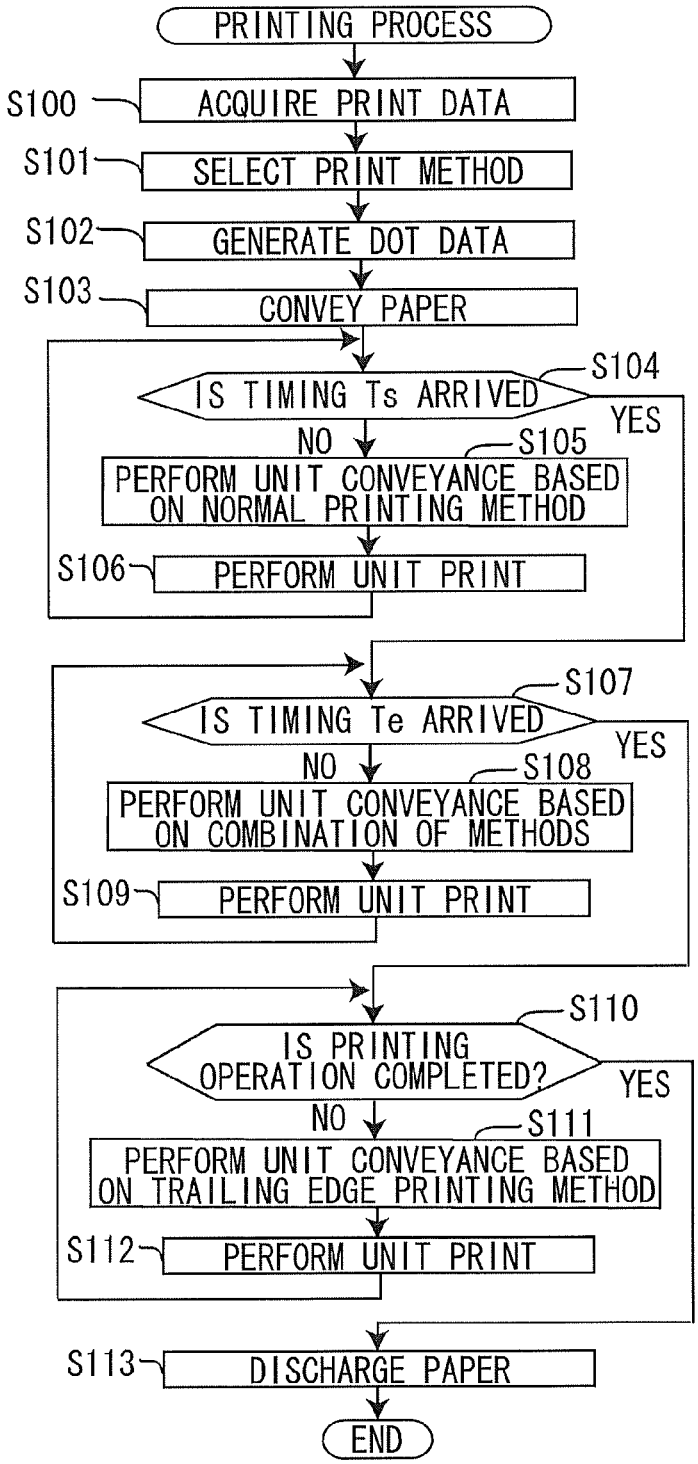
FIG. 5 is a flowchart illustrating steps in a printing process performed on the MFP.

FIG. 5 is a flowchart illustrating steps in a printing process performed on the MFP 200. The print control unit M20 of the MFP 200 executes this printing process when the MFP 200 receives a print job requiring interlaced printing.

In S100 of FIG. 5, the print control unit M20 extracts image data to be printed from the print job received by the MFP 200. The image data is data in the JPEG or BMP format or data described in a page description language, for example.

In S101 the printing method selection unit M21 of the print control unit M20 selects a printing method to be used in the printing process based on the number of passes in the interlaced printing method and the conveying properties of the conveyance mechanism 240 (sub-scanning properties).

Figure 6A:
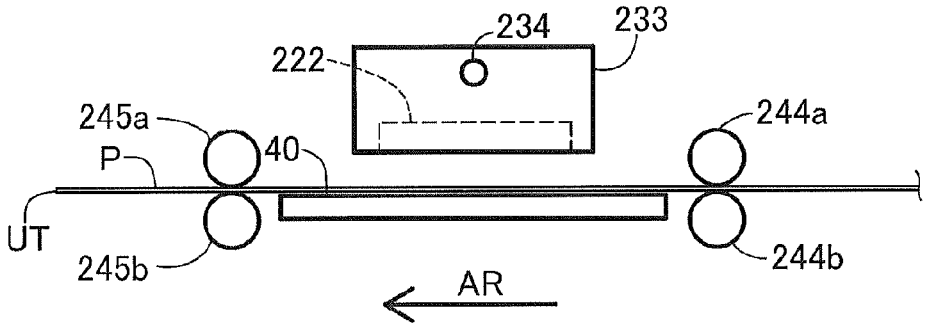
FIG. 6(*a*) is an explanation diagram showing a double-clamped state where a paper is gripped and conveyed by both an upstream clamping unit and a downstream clamping unit.
Figure 6B:
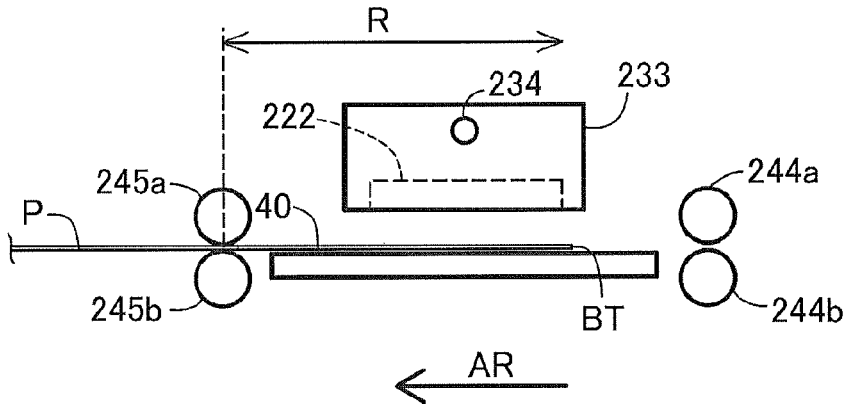
Figure 6C:
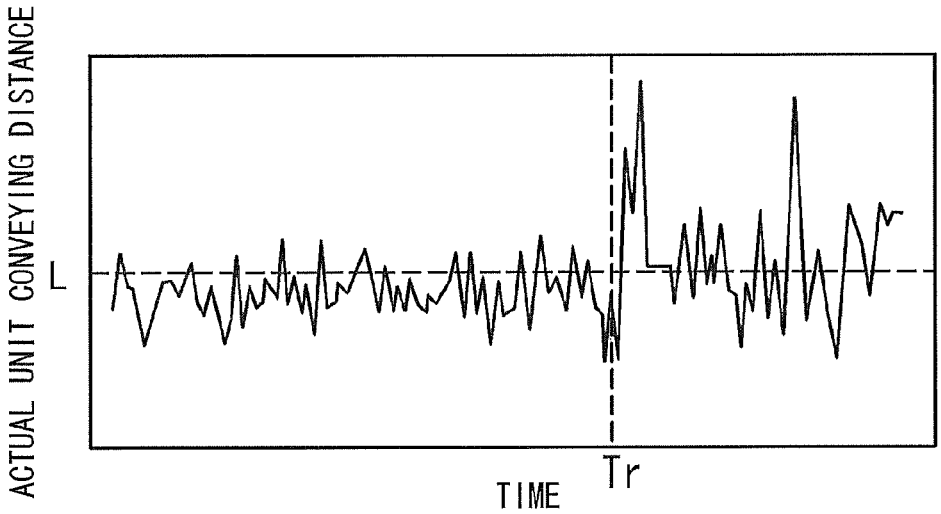
Figure 7:
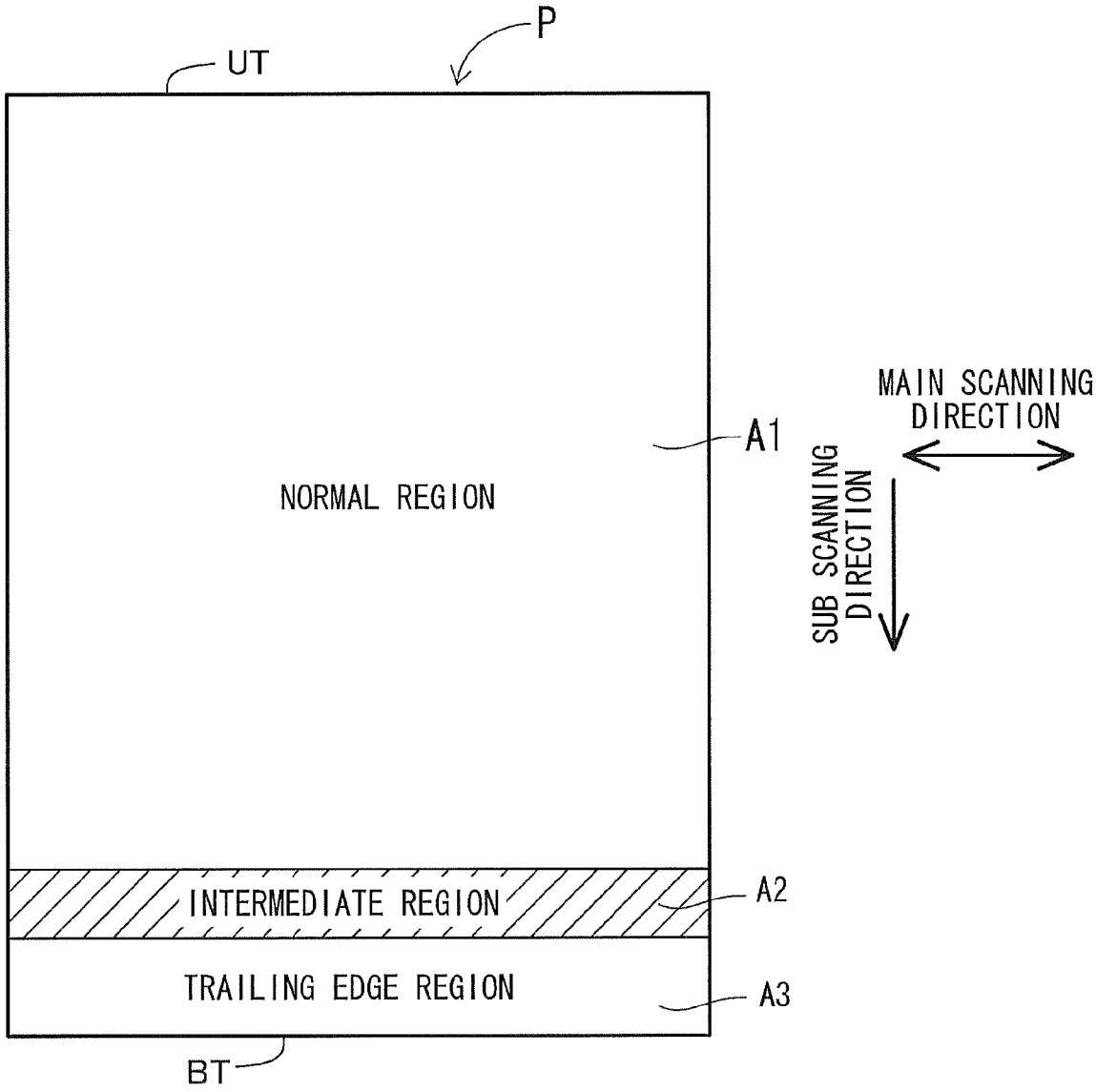
FIG. 7 is an explanation diagram illustrating different regions of a paper.

FIGS. 6(*a*)-6(*c*) illustrate the conveying properties of the conveyance mechanism 240. FIG. 7 illustrates different regions of the paper P. In a printing operation, a sheet of paper P is conveyed from the upstream side of the platen 40 relative to the conveying direction AR (from the right side in FIG. 6(*a*)). In this description, the edge of the conveyed sheet on the downstream end with respect to the conveying direction AR will be called the leading edge UT (see FIGS. 6(*a*) and 7), while the edge of the sheet on the upstream end relative to the conveying direction AR will be called the trailing edge BT (see FIGS. 6(*b*) and 7). Initially, the sheet of paper P is gripped and conveyed by the upstream clamping unit 244 until the leading edge UT of the paper P becomes interposed in the downstream clamping unit 245 (hereinafter, this state is referred to as an upstream single-clamped state). After the leading edge UT of the paper P becomes interposed in the downstream clamping unit 245, the paper P is gripped and conveyed by both the upstream clamping unit 244 and the downstream clamping unit 245 (hereinafter, this state is referred to as a double-clamped state; see FIG. 6(*a*)). As the sheet of paper P continues to be conveyed, the trailing edge BT of the sheet separates from the upstream clamping unit 244 at a certain timing and is thereafter gripped and conveyed only by the downstream clamping unit 245 (hereinafter, this state is referred to as a downstream single-clamped state). This timing will be called the trailing edge separation timing Tr. In other words, the clamped state of the paper P changes from the double-clamped state to the downstream single-clamped state at the trailing edge separation timing Tr.

With the above configuration, the conveying speed of the downstream clamping unit 245 is set slightly higher than that of the upstream clamping unit 244. This difference in conveying speed applies tension to the paper P that acts to pull the sheet taut in the conveying direction AR. Applying tension to the sheet in this way prevents problems in printing (that is, dot formation) precision that can occur when there is slack in the sheet. Therefore, the speed at which the paper P is conveyed in the downstream single-clamped state is faster than in the double-clamped state, resulting in a larger actual unit conveying distance produced by the conveyance mechanism 240 of the embodiment when the paper P is in the downstream single-clamped state than when the paper P is in the double-clamped state.

The graph in FIG. 6(*c*) shows variations in the actual unit conveying distance of the conveyance mechanism 240 during a printing operation. Prior to the trailing edge separation timing Tr (when the paper P is in the double-clamped state), the variation in unit conveying distance is relatively small and the average value of the actual unit conveying distance is smaller than the target unit conveying distance L. After the trailing edge separation timing Tr (when the paper P is in the downstream single-clamped state), on the other hand, variation in unit conveying distance is relatively high and the average value of the actual unit conveying distance is greater than the target unit conveying distance L. In other words, the conveyance mechanism 240 has conveying properties that tend to produce a negative conveying distance error ΔL when conveying the paper P in the double-clamped state and a positive conveying distance error ΔL when conveying the paper P in the downstream single-clamped state.

In the embodiment, the method of printing is changed for three regions A1, A2, and A3 of the paper P shown in FIG. 7. The trailing edge region A3 is a region of the paper P nearest the trailing edge BT. The normal region A1 is a region upstream of the trailing edge region A3 in the sub-scanning direction that includes the leading edge UT of the paper P. The intermediate region A2 is a region between the normal region A1 and the trailing edge region A3. The normal region A1, excluding the leading edge region near the leading edge UT, is printed while the paper P is in the double-clamped state. For the normal region A1, the MFP 200 prints using a normal printing method suited to conveying properties in the double-clamped state. The trailing edge region A3 is printed while the paper P is in the downstream single-clamped state. The MFP 200 prints the trailing edge region A3 using a trailing-edge printing method suited to conveying properties in the downstream single-clamped state. The intermediate region A2 is printed using a combination of the normal printing method and the trailing-edge printing method. The three regions A1, A2, and A3 are set such that the trailing edge separation timing Tr occurs during the process of printing the intermediate region A2.

When using eight-pass interlaced printing, in S101 of FIG. 5 the printing method selection unit M21 selects the 8n−3 method as the normal printing method described above and the 8n+3 method as the trailing-edge printing method. In the case of four-pass interlaced printing, on the other hand, the printing method selection unit M21 selects the 4n−1 method as the normal printing method and the 4n+1 method as the trailing-edge printing method. The reasoning for selecting these printing methods will be described next.

In the following description, PN(s) denotes the number of the pass for printing a raster line RL(s), where "s" stands for the raster number RN described above (see FIGS. 3(*a*)-4(*b*)), and PN(s+1) denotes the number of the pass for printing the raster line RL(S+1), which is adjacent to and downstream of the raster line RL(s) in the sub-scanning direction. A pass number difference ΔPN(s) denoting the difference between the two raster lines RL(s) and RL(s+1) is defined as ΔPN(s)=PN(s+1)−PN(s). ΔPN(s) is a non-zero integer. "ΔPN(s)=2" indicates that raster line RL(s+1) is printed in the second pass after the pass for printing raster line RL(s). "ΔPN(s)=−2" indicates that raster line RL(s+1) is printed two passes prior to the pass for printing the raster line RL(s).

The pass number difference ΔPN(s) is an index value for evaluating the line spacing error ΔD(s) between the two raster lines RL(s) and RL(s+1). Due to an error ΔL between the actual unit conveying distance and the target unit conveying distance L, the line spacing error ΔD(s) changes. As the line spacing error ΔD(s) increases, the actual line spacing grows wider than the target line spacing D, increasing the likelihood of white streaks being produced. When the actual unit conveying distance is greater than the target unit conveying distance L by the error ΔL, the line spacing error ΔD(s) can be expressed in the following equation (1).

$$\Delta D(s)=\Delta PN(s)\times\Delta L \quad (1)$$

The equation (1) signifies that the line spacing error ΔD(s) can be expressed by accumulating the conveying distance error ΔL a number of times equivalent to the absolute value of the pass number difference ΔPN(s). Hence, the absolute value of the line spacing error ΔD(s) increases as the absolute value of the pass number difference ΔPN(s) increases. Further, if the pass number difference ΔPN(s) is positive and the conveying distance error ΔL is positive, the actual line spacing will be greater than the target line spacing D. Similarly, if the pass number difference ΔPN(s) is negative and the conveying distance error ΔL is negative, the actual line spacing will be greater than the target line spacing D. Therefore, when the conveying distance error ΔL is positive (i.e., when the actual unit conveying distance is greater than the target unit conveying distance L) and when the pass number difference ΔPN(s) is positive, the potential for white streaks being produced between two raster lines corresponding to the pass number difference ΔPN(s) increases as the absolute value of pass number difference ΔPN(s) increases. When the conveying distance error ΔL is negative (i.e., when the actual unit conveying distance is smaller than the target unit conveying distance L), and when the pass number difference ΔPN(s) is negative, the potential for white streaks being produced between two raster lines corresponding to the pass number difference ΔPN(s) increases as the absolute value of the pass number difference ΔPN(s) increases.

Here, the pass number difference having the largest absolute value among the pass number differences ΔPN(s) for all pairs of adjacent raster lines in the printer image will be called the maximum pass number difference. Further, the pass number difference having the largest absolute value among all positive pass number differences ΔPN(s) will be called the maximum positive pass number difference and the pass number difference having the largest absolute value among all negative pass number differences ΔPN(s) will be called the maximum negative pass number difference.

The following points can be understood from the above description.

1. When the conveying distance error ΔL is positive, white streaks are less likely to be produced in printing methods having a smaller absolute value of the maximum positive pass number difference.

2. When the conveying distance error ΔL is negative, white streaks are less likely to be produced in printing methods having a smaller absolute value of the maximum negative pass number difference.

Based on the above points, the two four-pass printing methods shown in FIGS. 3(*a*) and 3(*b*) will be considered. For the 4n+1 printing method (see FIG. 3(*a*)), the pass number difference ΔPN(s) takes on one of the values "−3" or "1". For example, the pass number difference ΔPN(4) between raster lines RL(4) and RL(5) is "−3" (indicated by the dotted line c1 in FIG. 3(*a*)). The pass number difference ΔPN(2) between raster lines RL(2) and RL(3) is "1" (indicated by the dotted line c2 in FIG. 3(*a*)). Hence, the maximum pass number difference and the maximum negative pass number difference for the 4n+1 printing method are both "−3", while the maximum positive pass number difference is "1".

For the 4n−1 printing method (see FIG. 3(*b*)), the pass number difference ΔPN(s) takes on one of the values "3" or "−1". For example, the pass number difference ΔPN(3) between raster lines RL(3) and RL(4) is "3" (indicated by the dotted line c1 in FIG. 3(*b*)). The pass number difference ΔPN(4) between raster lines RL(4) and RL(5) is "−1" (indicated by the dotted line c2 in FIG. 3(*b*)). Hence, the maximum pass number difference and the maximum positive pass number difference for the 4n−1 printing method are both "3", while the maximum negative pass number difference is "−1".

The maximum positive pass number difference in the 4n+1 method has a smaller absolute value than the absolute value of the maximum positive pass number difference in the 4n−1 method. Therefore, the 4n+1 method is less likely to produce white streaks than the 4n−1 method when the conveying distance error ΔL is positive, i.e., when the actual unit conveying distance is greater than the target unit conveying distance L. However, the maximum negative pass number difference in the 4n−1 method has a smaller absolute value than the absolute value of the maximum negative pass number difference in the 4n+1 method. Therefore, the 4n−1 method is less likely to produce white streaks than the 4n+1 method when the conveying distance error ΔL is negative, i.e., when the actual unit conveying distance is smaller than the target unit conveying distance L.

Based on the above description, it is clear that, when a four-pass method of interlaced printing is to be used, the 4n−1 method is preferred as the normal printing method to be used in the double-clamped state when a negative conveying distance error ΔL is likely to occur and that the 4n+1 method is preferred as the trailing-edge printing method to be used in the downstream single-clamped state when a positive conveying distance error ΔL is likely to occur.

Next, the two eight-pass printing methods shown in FIGS. 4(*a*) and 4(*b*) will be considered. For the 8n+3 method (see FIG. 4(*a*)), the pass number difference ΔPN(s) takes on one of the values "−5" or "3". For example, the pass number difference ΔPN(2) between raster lines RL(2) and RL(3) is "−5" (indicated by the dotted line c1 in FIG. 5(*a*)). The pass number difference ΔPN(4) between raster lines RL(4) and RL(5) is "3" (indicated by the dotted line c2 in FIG. 5(*a*)). Hence, the maximum pass number difference and the maximum negative pass number difference for the 8n+3 printing method are both "−5", while the maximum positive pass number difference is "3".

For the 8n−3 method (FIG. 4(*b*)), the pass number difference ΔPN(s) takes on one of the values "5" or "−3". For example, the pass number difference ΔPN(5) between raster lines RL(5) and RL(6) is "5" (indicated by the dotted line c1 in FIG. 5(*b*)). The pass number difference ΔPN(6) between raster lines RL(6) and RL(7) is "−3" (indicated by the dotted line c2 in FIG. 5(*b*)). Hence, the maximum pass number difference and the maximum positive pass number difference for the 8n−3 printing method are both "5", while the maximum negative pass number difference is "−3".

The maximum positive pass number difference in the 8n+3 method has a smaller absolute value than the absolute value of the maximum positive pass number difference in the 8n−3 method. Therefore, the 8n+3 method is less likely to produce white streaks than the 8n−3 method when the conveying distance error ΔL is positive, i.e., when the actual unit conveying distance is greater than the target unit conveying distance L. However, the maximum negative pass number difference in the 8n−3 method has a smaller absolute value than the absolute value of the maximum negative pass number difference in the 8n+3 method. Therefore, the 8n−3 method is less likely to produce white streaks than the 8n+3 method when the conveying distance error ΔL is negative, i.e., when the actual unit conveying distance is smaller than the target unit conveying distance L.

As is clear in the above description, for eight-pass interlaced printing, the 8n−3 method is preferable for the normal printing method to be used in the double-clamped state when a negative conveying distance error ΔL is likely to occur, and that the 8n+3 method is preferable for the trailing-edge printing method to be used in the downstream single-clamped state when a positive conveying distance error ΔL is likely to Occur.

After selecting a printing method in S101 of FIG. 5, in S102 the print control unit M20 generates dot data for printing using the selected printing method based on the image data. The dot data is generated through various processes known in the art, including a color conversion process, halftone process, and a process to shift the data into a printing order suited to the printing method.

In S103 the print control unit M20 controls the conveyance mechanism 240 to convey (feed) a sheet of paper P to the upstream side of the platen 40. In S104 the print control unit M20 determines whether a timing Ts for starting a printing operation with the trailing-edge printing method has arrived. The trailing-edge printing method start timing Ts is the timing for performing a unit conveyance that is prior to a prescribed number of unit conveyances from the trailing edge separation timing Tr, for example.

If the trailing-edge printing method start timing Ts has not arrived (S 104: NO), then the normal print control unit M22 of the print control unit M20 continues printing using the normal printing method. More specifically, in S105 the normal print control unit M22 performs a unit conveyance based on the normal printing method, and in S106 performs a unit print based on the normal printing method. When the trailing-edge printing method start timing Ts has arrived (S104: YES), in S107 the print control unit M20 determines whether a timing Te for ending a printing operation using the normal printing method has arrived. The normal printing method end timing Te is the timing at which a unit conveyance is performed a prescribed number of unit conveyances after the trailing-edge printing method start timing Ts, for example.

If the normal printing method end timing Te has not arrived (S107: NO), then the combination print control unit M23 of the print control unit M20 performs a printing operation combining the normal printing method and the trailing-edge printing method. More specifically, in S108 the combination print control unit M23 performs a unit conveyance adjusted to a combination of the normal printing method and the trailing-edge printing method, and in S109 performs a unit print adjusted to the combination of the normal printing method and the trailing-edge printing method. When the normal printing method end timing Te arrives (S 107: YES), in S110 the print control unit M20 determines whether the printing operation has completed.

If the printing operation has not completed (S110: NO), then the trailing-edge print control unit M24 of the print control unit M20 performs a printing operation using the trailing-edge printing method. That is, in S111 the trailing-edge print control unit M24 performs a unit conveyance based on the trailing-edge printing method, and in S112 performs a unit print based on the trailing-edge printing method. When the printing operation has completed (S104: YES), in S113 the print control unit M20 discharges the sheet of paper P onto the discharge tray 21, and subsequently ends the printing process.

Figure 8:
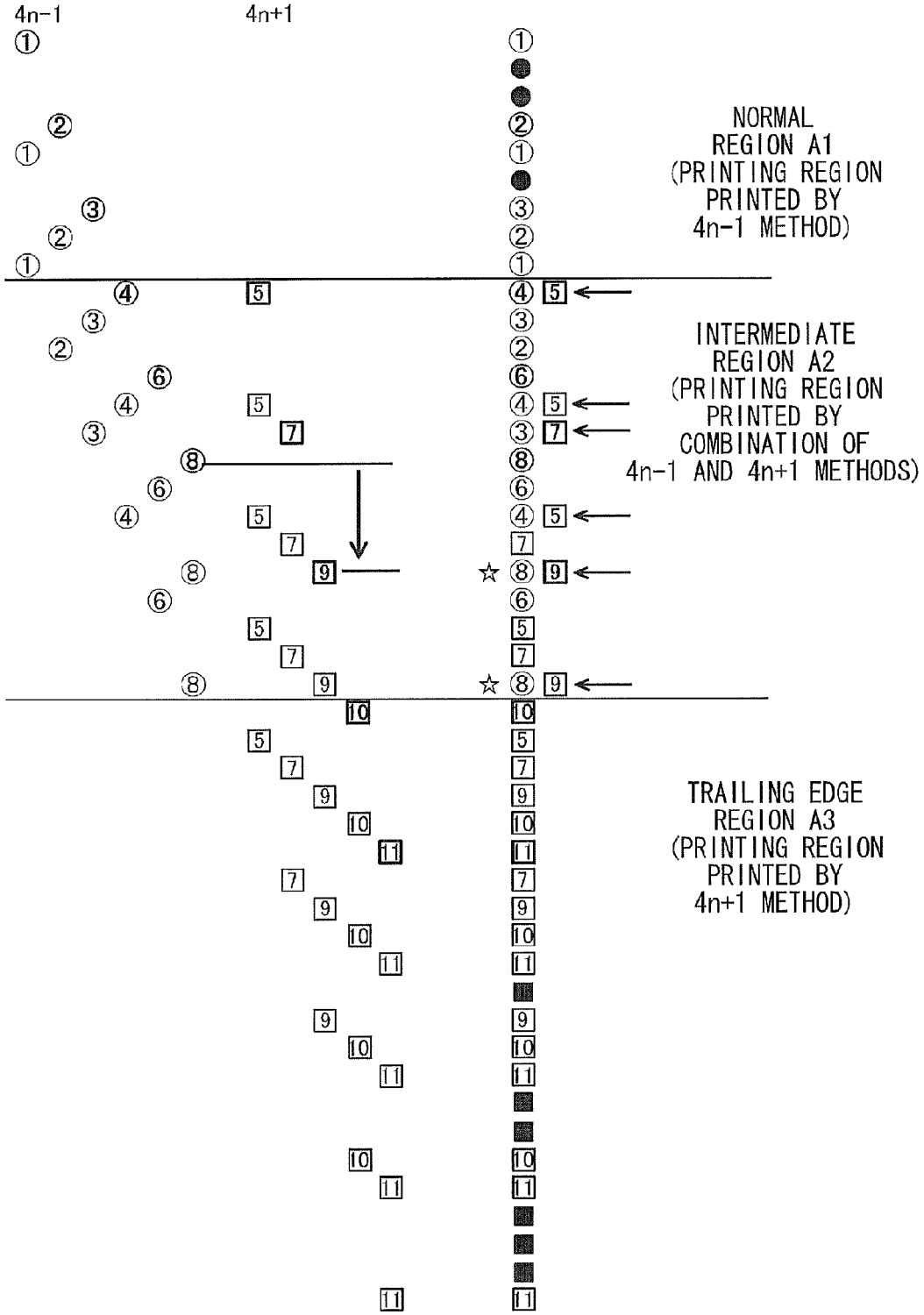
FIG. 8 is an explanation diagram illustrating examples of four-pass printing methods.

FIG. 8 shows examples of four-pass printing methods. In the left side of FIG. 8, the circles represent the nozzle positions in each pass (main scan) in the 4n−1 method used as the normal printing method, while the squares represent the nozzle positions in each pass in the 4n+1 method used as the trailing-edge printing method. The numbers inside the circles and squares represent the number of the pass being executed. The pass numbers indicate the order in which passes are actually executed irrespective of the printing methods. The right side of FIG. 8 indicates which raster lines are printed in each pass for each printing method. For example, the raster line indicated by the number "6" in a circle is printed in the sixth pass during the 4n−1 method. Raster lines depicted with a filled black circle in the right side of FIG. 8 were printed in a pass performed prior to pass number 1. Raster lines depicted with a filled black square in the right side of FIG. 8 are to be printed in a later pass following pass number 11.

During a printing operation, as shown in FIG. 8, the 4n−1 printing method is switched to the 4n−1 printing method. Hereinafter, the 4n−1 printing method is referred to as the printing method prior to the switch, and the 4n+1 method is referred to as the new printing method or referred to as the printing method after the switch. It is conceivable that the printing methods are switched to the 4n+1 method all together after the prescribed switching moment before which all the raster lines are printed by the 4n−1 printing method. In this conceivable case, it is not possible to print all raster lines using the new printing method immediately after the prescribed switching moment. That is, some raster lines cannot be printed with the new printing method if the printing methods are switched to the 4n+1 method all together after the prescribed switching moment before which all the raster lines are printed by the 4n−1 printing method. For example, the top portion in the intermediate region A2 of FIG. 8 cannot be printed with the 4n+1 method. In the embodiment, for the region A2, a prescribed number of unit prints are performed using the printing method prior to the switch so that raster lines are not skipped. This results in the intermediate region A2 between the normal region A1 and the trailing edge region A3 for printing using a combination of both printing methods before and after the switch.

In the example shown in FIG. 8, the passes numbered 2-4, 6, and 8 use the 4n−1 method and the passes numbered 5, 7, and 9 use the 4n+1 method. The intermediate region A2 includes raster lines in which dots can be formed both in a pass of the printing method prior to switching methods and in a pass of the printing method after switching methods (hereinafter referred to as "special raster lines"). Raster lines marked with both circles and squares in the right side of FIG. 8 are special raster lines. A left arrow is also included on the right side of each special raster line. In the embodiment, the combination print control unit M23 executes a shingling printing method for the special raster lines. Shingling is a technique for forming dots in a single raster line using a plurality of passes. In the example of FIG. 8, star symbols have been included next to two special raster lines in which dots have been formed both in pass number 8, when using the 4n−1 method, and pass number 9, when using the 4n+1 method. More specifically, the combination print control unit M23 forms dots in a pass of the 4n−1 method at even-numbered dot-forming positions along the main scanning direction of the special raster lines and forms dots in a pass of the 4n+1 method at odd-numbered dot-forming positions along the main scanning direction.

As shown in FIG. 8, for example, the pass numbered 3 prints the raster line in both the normal region A1 and the intermediate region A2. In the intermediate region A2, there is the special raster line that can be printed by the passes numbered 3 and 7. In this case, this special line may not be printed by the pass numbered 3 but be printed only by the pass numbered 7. When the print head 222 prints the intermediate region A2, a part of nozzle prints the raster line in the normal region A1 or the trailing edge region A3, and another part of nozzles prints the raster line in the intermediate region A2. The part of nozzles that prints the raster line in the normal region A1 or the trailing edge region A3 is determined according to the definition of the kn+1 method described above (that is, 4n+1 when the part of nozzles prints the raster line in the normal region A1, or 4n−1 when the part of nozzles prints the raster line in the trailing edge region A3, in this example). In FIG. 8, each pass in which the intermediate region A2 is printed is classified into one of 4n−1 and 4n+1 methods based on the method that defines this part of nozzles. Here, another part of nozzles to print the raster line in the intermediate region A2 may be deleted or modified from the nozzles determined by the definition of the kn+1 method (that is, in this example, the 4n+1 or 4n−1 method) in order to properly print the raster lines in the intermediate region A2.

In four-pass interlaced printing according to the embodiment, the regions A1-A3 are configured such that the timing at which a unit conveyance is performed following pass number 8 in the 4n−1 method (indicated by the downward pointing arrow in FIG. 8) corresponds to the trailing edge separation timing Tr. This timing corresponds to the area of the image having the most special main scan lines in which the earlier pass between the pass in the normal printing method (the 4n−1 method in this example) and the pass in the trailing-edge printing method (the 4n+1 method in this example) has been completed, while the later pass has not. In FIG. 8 the two raster lines indicated by star symbols (generally 2n lines, here in the embodiment n is sets to 1) are the special main scan lines whose earlier pass has been completed but whose later pass has not at the point the pass number 8 was completed.

Figure 9:
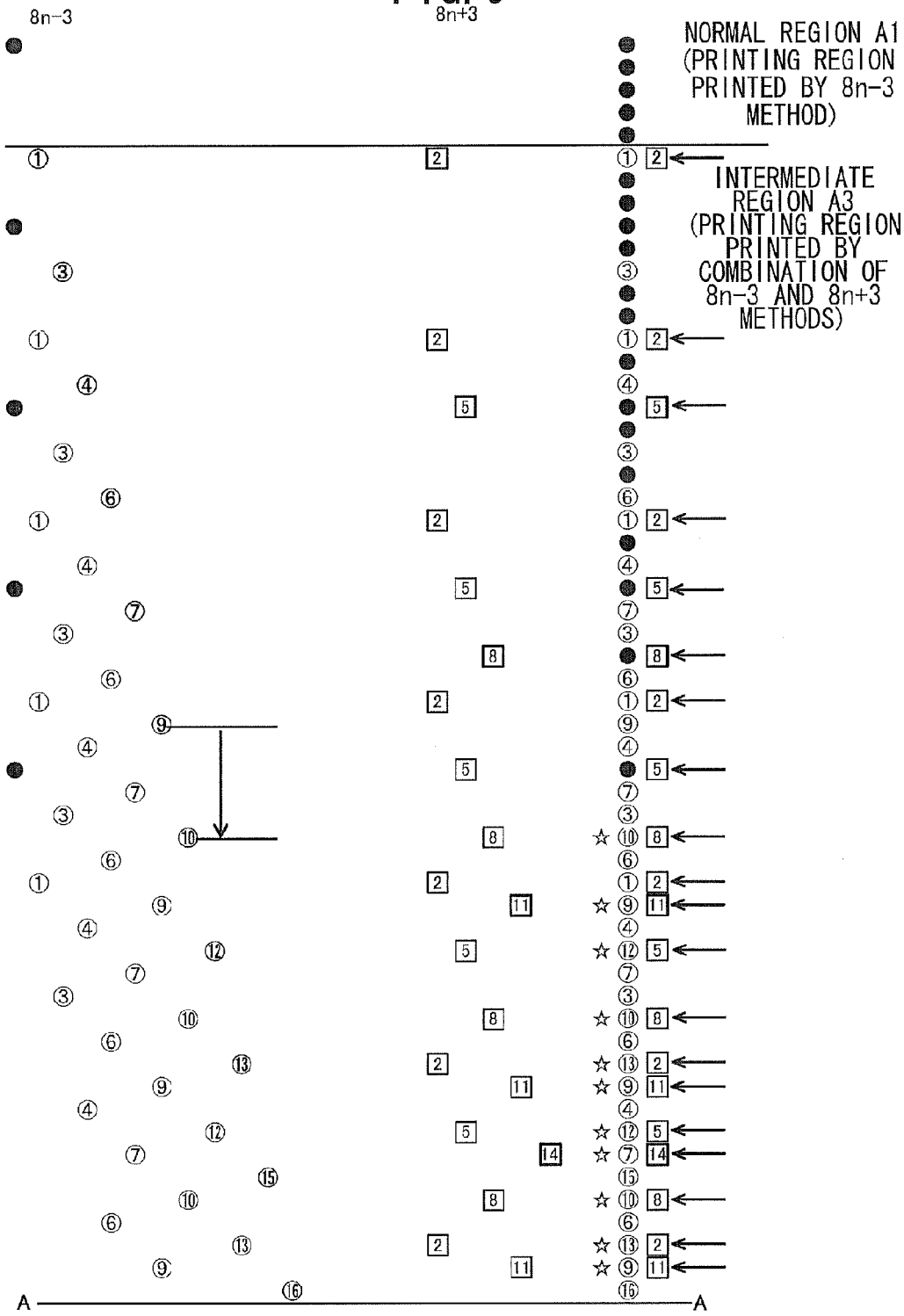
FIG. 9 is an explanation diagram illustrating examples of eight-pass printing methods.
Figure 10:
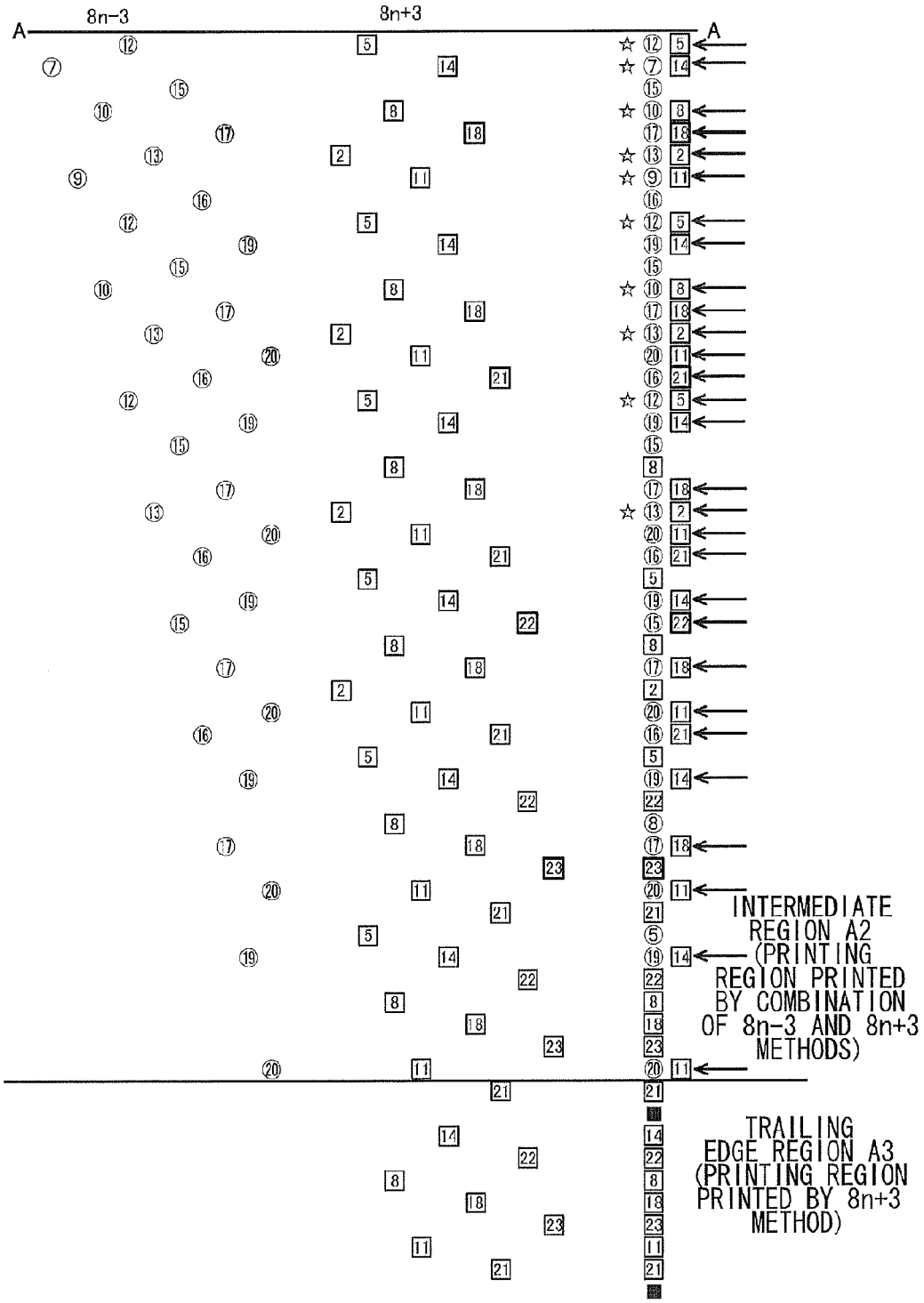
FIG. 10 is an explanation diagram illustrating the examples of eight pass printing methods that continues downstream in a sub-scanning direction from a bottom of FIG. 9 indicated by the line A-A.

FIGS. 9 and 10 illustrate examples of eight-pass printing methods. FIG. 10 continues downstream in the sub-scanning direction from the bottom of FIG. 9 indicated by the line A-A. The notation used in FIGS. 9 and 10 is the same as that in FIG. 8.

In the left side of FIGS. 9 and 10, the circles represent the nozzle positions in each pass (main scan) in the 8n−3 method used as the normal printing method, while the squares represent the nozzle positions in each pass in the 8n+3 method used as the trailing-edge printing method. The numbers inside the circles and squares represent the number of the pass being executed. The pass numbers indicate the order in which passes are actually executed irrespective of the printing methods. The right side of FIGS. 9 and 10 indicates which raster lines are printed in each pass for each printing method. For example, the raster line indicated by the number "6" in a circle is printed in the sixth pass during the 8n−3 method.

Similarly to the example shown in FIG. 8, the intermediate region A2 includes special raster lines. As described above, the combination print control unit M23 executes a shingling printing method for the special raster lines. Specifically, the combination print control unit M23 forms dots in a pass of the 8n−3 method at even-numbered dot-forming positions along the main scanning direction of the special raster lines and forms dots in a pass of the 8n+3 method at odd-numbered dot-forming positions along the main scanning direction.

In eight-pass interlaced printing according to the embodiment, the regions A1-A3 are configured such that the timing at which a unit conveyance is performed following pass number 9 in the 8n−3 method (indicated by the downward pointing arrow in FIG. 9) corresponds to the trailing edge separation timing Tr. This timing corresponds to the area of the image having the most special main scan lines in which the earlier pass between the pass in the normal printing method (the 8n−3 method in this example) and the pass in the trailing-edge printing method (the 8n+3 method in this example) has been completed, while the later pass has not. In FIGS. 9 and 10 the two raster lines indicated by star symbols (generally 21n lines, here in the embodiment n is sets to 1) are the special main scan lines whose earlier pass has been completed but whose later pass has not at the point the pass number 8 was completed.

When performing interlaced printing, the MFP 200 according to the second embodiment described above can print using different printing methods for the normal region A1 in which the sheet being printed is mainly in a double-clamped state, and the trailing edge region A3 in which the sheet is in a downstream single-clamped state. Therefore, the MFP 200 can employ a printing method suited to the conveying properties in each state, reducing the potential for defects in image quality (that is, the occurrence of white streaks) in the normal region A1 and the trailing edge region A3. Further, the MFP 200 executes a shingling printing method for special raster lines in the intermediate region A2 by combining the two printing methods. Specifically, the combination print control unit M23 forms dots in the special raster lines in both a pass of the normal printing method and a pass of the trailing-edge printing method. Shingling can reduce defects in image quality, such as white streaks and other types of banding, by distributing fluctuations in conveying properties, and specifically the conveying distance error ΔL in the actual unit conveying distances. Therefore, the invention can reduce the potential for banding and other printing defects due to fluctuations in conveying properties that result when the sheet being printed changes from the double-clamped state to the downstream single-clamped state.

The MFP 200 forms dots in special raster lines by recording dots in a pass of the normal printing method at even-numbered dot-forming positions along the main scanning direction and dots in a pass of the trailing-edge printing method at odd-numbered dot-forming positions along the main scanning direction. Therefore, the invention can more effectively reduce the potential for banding and other printing defects due to fluctuations in conveying properties that result when the sheet being printed changes from the double-clamped state to the downstream single-clamped state.

Further, the regions A1-A3 are set such that, at the trailing edge separation timing Tr, there exists the largest number of special raster lines in which the earlier pass between the pass of the normal printing method and the pass of the trailing-edge printing method has been completed while the other later pass has not. Therefore, the invention can more effectively reduce the potential for banding and other printing defects due to fluctuations in conveying properties that result when the sheet being printed changes from the double-clamped state to the downstream single-clamped state.

Since the number of passes performed in the normal printing method is equivalent to the number of passes performed in the trailing-edge printing method in one printing operation, the MFP 200 can maintain printing resolution while preventing defects in the printed image.

B. Variations of the Embodiments

While the invention has been described in detail with reference to the embodiments thereof, it would be apparent to those skilled in the art that various changes and modifications may be made therein without departing from the scope of the invention.

(1) The MFP 200 of the embodiment described above changes the printing method used for printing the intermediate region A2 when the clamped state of the paper being printed changes from the double-clamped state to the downstream single-clamped state. However, it is also possible to change the printing method for printing an intermediate region during an initial stage of printing when the supported state of the paper changes from the upstream single-clamped state to the double-clamped state, for example. In other words, the printing region can be divided into a leading edge region near the leading edge UT of the paper P that is printed when the paper P is in the upstream single-clamped state, a central region near the center of the paper P that is printed while the paper P is in the double-clamped state, and an intermediate region provided between the leading edge region and the central region. In the leading edge region, interlaced printing is performed using a printing method suited to printing on paper in the upstream single-clamped state. In the central region, interlaced printing is executed using a printing method suited to printing on paper in the double-clamped state that differs from the special printing method. In the intermediate region, interlaced printing is executed by combining both of these printing methods. The regions are set such that the supported state of the paper changes from the upstream single-clamped state to the double-clamped state while printing in the intermediate region. The shingling printing method may also be executed using passes in both of the above printing methods for special raster lines in the intermediate region.

This variation can suppress a decline in printing quality both in a region of the paper printed while the paper is in the upstream single-clamped state and s region of the paper printed while the paper is in the double-clamped state. The variation can also reduce defects in image quality caused by fluctuations in conveying properties when the paper changes from the upstream single-clamped state to the double-clamped state.

(2) The four types of printing methods described in the embodiments are all examples of interlaced printing methods, but various other types of printing methods may be employed. For example, the 8n−1 method may be used in place of the 8n−3 method as the eight-pass normal printing method, and the 8n+1 method may be used in place of the 8n+3 method as the eight-pass trailing-edge printing method. When employing other printing methods, a suitable printing method can be selected for the normal printing method and the trailing-edge printing method by evaluating the relationship between conveying properties of the printing method and the generation of white streaks using the technique described in the embodiments. For example, when employing printing methods that use uniform conveyance in which the uniform conveying distance is expressed by $D\times(k\times n+b)$ (where D is the target line spacing, n is a natural number set based on the number of nozzles being used, k is the number of passes represented by N/D and is 3 or greater, and b is a non-zero integer that satisfies the expression $-(1/2)k<b<(1/2)k$), a printing method producing a negative b value may be employed as the normal printing method and a printing method producing a positive b value may be employed as the trailing-edge printing method. Further, printing methods with different numbers of passes may be employed for the normal printing method and the trailing-edge printing method.

(3) In the embodiments described above, the combination print control unit M23 forms dots at even-numbered dot-forming positions along the main scanning direction of special raster lines in a pass of the normal printing method, and forms dots at odd-numbered dot-forming positions of special raster lines in a pass of the trailing-edge printing method. However, the combination print control unit M23 may also form dots in a pass of the normal printing method targeting any portion of the dot-forming positions in the special raster line. In this case, the combination print control unit M23 forms dots in a pass of the trailing-edge printing method that target the remaining dot-forming positions. However, it is preferable that the combination print control unit M23 forms dots at discontinuous dot-forming positions in each special raster line in a pass of the normal printing method and forms dots targeting the other dot-forming positions of each special raster line in a pass of the trailing-edge printing method.

(4) When an entire raster line can be formed in a pass of one of the differing printing methods, the main scan of the other printing method for the same raster line can be omitted, thereby improving printing speed. For example, since the fourth pass of the 4n−1 method is entirely covered by the fifth pass of the 4n+1 method, a main scan may be performed for the fifth pass of the 4n+1 method while omitting a scan for the fourth pass of the 4n−1 method. In this case, shingling described in the embodiments for conducting main scans both for the fourth pass of the 4n−1 method and the fifth pass of the 4n+1 method is not performed since all dots in the target raster line can be formed in the fifth pass of the 4n+1 method.

(5) Part of the configuration of the invention implemented in hardware in the embodiments described above may be replaced by software and, conversely, part of the configuration of the invention implemented in software may be replaced by hardware.

What is claimed is:

1. A printing device comprising:

a print head including a plurality of nozzles arranged in a first direction and spaced apart by a prescribed nozzle pitch, the plurality of nozzles being configured to form dots having a same color on a recording sheet;

a conveying portion configured to convey a recording sheet in the first direction, the conveying portion including an upstream clamping portion disposed upstream of the print head in the first direction and a downstream clamping portion disposed downstream of the print head in the first direction, the upstream clamping portion and the downstream clamping portion configured to clamp and convey the recording sheet thereat;

a main scanning portion configured to perform a scan in which the main scanning portion moves the print head relative to the recording sheet in a second direction different from the first direction;

a head drive portion configured to drive at least one nozzle of the plurality of nozzles to form dots such that a raster line configured of the dots extends in a second direction different from the first direction; and a print control processor configured to perform a print operation in a resolution in which a plurality of raster lines is arranged in the first direction by a line pitch smaller than the nozzle pitch by using a first print method and a second print method and by controlling the print head, the conveying portion, the main scanning portion, and the head drive portion, each of the first print method and the second print method printing the plurality of raster lines in a prescribed order, the prescribed order being specific to each of the first print method and the second print method, the print control processor being configured to function as:

a first control unit configured to print, by the first print method, an image on a first region of the recording sheet in a first state in which the recording sheet is clamped by both the upstream clamping portion and the downstream clamping portion;

a second control unit configured to print, by the second print method, an image on a second region of the recording sheet in a second state in which the recording sheet is clamped only by the downstream clamping portion; and a third control unit configured to print, by a combination of the first print method and the second print method, an image on a third region of the recording sheet, the third region being between the first region and the second region, wherein when the third control unit prints the image on the third region, a state of the recording sheet is set to be changed from the first state to the second state, wherein in the first method, the main scanning portion performs a first scan as the scan, whereas in the second method, the main scanning portion performs a second scan as the scan, wherein the third control unit is configured to form dots to form at least one special raster line in the second direction in the third region during both the first scan in the first print method and the second scan in the second print method, wherein the conveying portion conveys the recording sheet in the first direction by a conveying distance specific to each of the first print method and the second print method, wherein each of the first print method and the second print method is configured to set the conveying distance expressed by $D\times(k\times n+b)$, where D represents a line pitch, n represents a natural number set based on number of the at least one nozzle being used, k is a number of passes given by N/D and is 3 or greater wherein N indicates a nozzle pitch, and b is a non-zero integer satisfying $-(1/2)k<b<(1/2)k$, wherein in the first print method a value of b to specify the conveying distance is negative whereas in the second print method the value of b to specify the conveying distance is positive.

2. The printing device according to claim 1, wherein the third control unit configured to form dots at discontinuous positions apart from one another in the second direction on the at least one special raster line during the first scan and form dots at remaining position other than the discontinuous positions on the at least one special raster line during the second scan.

3. The printing device according to claim 1, wherein a state of the recording sheet is changed from the first state to the second state when number of the at least one special raster line that has been printed by using the first method and that is not printed by using the second method becomes maximum.

4. The printing device according to claim 1, wherein number of passes k of the first method is the same with number of passes k of the second method, where number of passes k is given by N/D where N represents the nozzle pitch and D represents the line pitch.

5. A non-transitory computer readable storage medium storing a set of program instructions installed on and executed by a computer for controlling a printing device comprising: a print head including a plurality of nozzles arranged in a first direction and spaced apart by a prescribed nozzle pitch, the plurality of nozzles being configured to form dots having a same color on a recording sheet; a conveying portion configured to convey a recording sheet in the first direction, the conveying portion including an upstream clamping portion disposed upstream of the print head in the first direction and a downstream clamping portion disposed downstream of the print head in the first direction, the upstream clamping portion and the downstream clamping portion configured to clamp and convey the recording sheet thereat; a main scanning portion configured to perform a scan in which the main scanning portion moves the print head relative to the recording sheet in a second direction different from the first direction; and a head drive portion configured to drive at least one nozzle of the plurality of nozzles to form dots such that a raster line configured of the dots extends in a second direction different from the first direction, the program instructions comprising (a) performing a print operation in a resolution in which a plurality of raster lines is arranged in the first direction by a line pitch smaller than the nozzle pitch by using a first print method and a second print method and by controlling the print head, the conveying portion, the main scanning portion, and the head drive portion, each of the first print method and the second print method printing the plurality of raster lines in a prescribed order, the prescribed order being specific to each of the first print method and the second print method. The performing instruction (a) including:

(a-1) printing, by the first print method, an image on a first region of the recording sheet in a first state in which the recording sheet is clamped by both the upstream clamping portion and the downstream clamping portion;

(a-2) printing, by the second print method, an image on a second region of the recording sheet in a second state in which the recording sheet is clamped only by the downstream clamping portion; and (a-3) printing, by a combination of the first print method and the second print method, an image on a third region of the recording sheet, the third region being between the first region and the second region, wherein when the printing instruction (a-3) prints the image on the third region, a state of the recording sheet is set to be changed from the first state to the second state, wherein in the first method, the main scanning portion performs a first scan as the scan, whereas in the second method, the main scanning portion performs a second scan as the scan, wherein the printing instruction (a-3) forms dots to form at least one special raster line in the second direction in the third region during both the first scan in the first print method and the second scan in the second print method, wherein the instructions further comprise controlling the conveying portion to convey the recording sheet in the first direction by a conveying distance specific to each of the first print method and the second print method, wherein each of the first print method and the second print method is configured to set the conveying distance expressed by $D\times(k\times n+b)$, where D represents a line pitch, n represents a natural number set based on number of the at least one nozzle being used, k is a number of passes given by N/D and is 3 or greater wherein N indicates a nozzle pitch, and b is a non-zero integer satisfying $-(1/2)k<b<(1/2)k$, wherein in the first print method a value of b to specify the conveying distance is negative whereas in the second print method the value of b to specify the conveying distance is positive.

* * * * *